US006065887A

United States Patent [19]

You

[11] Patent Number: 6,065,887

[45] Date of Patent: May 23, 2000

[54] CORRECTION TAPE WITH A CAP HOLDER

[76] Inventor: Kwang Ho You, 59-37 Songrim-Dong, Dong-Gu, Inchon City, Rep. of Korea, 401-073

[21] Appl. No.: 09/104,696

[22] Filed: Jun. 25, 1998

[51] Int. Cl.[7] ..... B41J 11/60

[52] U.S. Cl. ..... 400/697

[58] Field of Search ..... 400/697; D19/69, D19/67, 68; 225/6–7, 25, 34, 35; 156/523, 506, 510, 527

[56] References Cited

U.S. PATENT DOCUMENTS

| | | | |
|---|---|---|---|
| D. 337,787 | 7/1993 | Oga et al. | D19/69 |
| D. 355,934 | 2/1995 | Oga et al. | D19/69 |
| D. 378,532 | 3/1997 | Suzuki | D19/69 |
| D. 410,955 | 6/1999 | Hoffmann | D19/69 |
| 5,490,898 | 2/1996 | Koyama | 156/540 |
| 5,795,085 | 8/1998 | Yoo | 400/248 |

*Primary Examiner*—John S. Hilten
*Assistant Examiner*—Charles H. Nolan, Jr.
*Attorney, Agent, or Firm*—Walter J. Tencza, Jr.

[57] ABSTRACT

This design, regarding to the correction tape, while former correction tapes have a possibility that dust or foreign materials stick on it, and are unhandy to carry, protects correction tape with a cap and cap holder when not in use. Also when in use, a cap can be placed on holder and it is handy to carry with an installation of clip, ring on the surface of the case and used for correction of writing errors or omitted words.

19 Claims, 4 Drawing Sheets

CORRECTION TAPE WITH A CAP HOLDER

FIELD OF THE INVENTION

The present invention relates to methods and apparatus for correcting written mistakes and more particularly to devices known as correction tapes.

BACKGROUND OF THE INVENTION

There are devices known in the art for correcting written mistakes such as "white out" and certain types of correction tapes.

CLAIM FOR FOREIGN PRIORITY

This application claims the foreign priority of Korean Application No. to be provided, which was filed on Dec. 31, 1997.

SUMMARY OF THE INVENTION

The present invention in one embodiment provides an improved form of correction tape for "whiting out" or correcting written mistakes. The purpose of one embodiment of the present invention is not only to carry the correction tape conveniently but also to provide long life because in one embodiment the present invention can prevent penetration of dust or foreign materials into the inside of the correction tape.

In a correction tape which is equipped with a case of a certain shape a thin tape is provided wound around a first roll which is placed in a case and rotatable in its place. A second roll is placed near the first roll. Thin tape released from the first roll passes through a certain path and is wound around a tape guide, said tape guide being placed on the outside of the case. The tape guide leads the movement of the thin tape and pushes the thin tape towards a paper surface when necessary. The purpose of this embodiment can be achieved by the correction tape which is comprised of a cap which can be put on or removed and protects the tape guide and the thin tape which is otherwise exposed to the outside. A cap holder, placed on the outside of a case, can hold the cap when necessary.

It is desirable that a clip is equipped and the correction tape can be put into the pocket. Furthermore, easy on and off of the clip from the case when necessary shall be better.

Also, in one embodiment a slot with a certain length, shall be formed at one side of the cap near the opening hole for placing on the tape guide and one bump each shall be made at both internal sides of the cap by which the cap shall be caught between the case and the tape guide.

Furthermore, a check hole shall be made at one side of the case in order to check how much the correction tape shall be used and it will be better that a ring shall be hooked in the cap holder.

DETAILED DESCRIPTION OF THE DRAWINGS

The present invention in one embodiment relates to a correction tapes which can correct to the necessary form by putting a correction liquid onto the wrong written spot with pushing thin tape on which correction liquid has been coated and dried.

Figure 1:
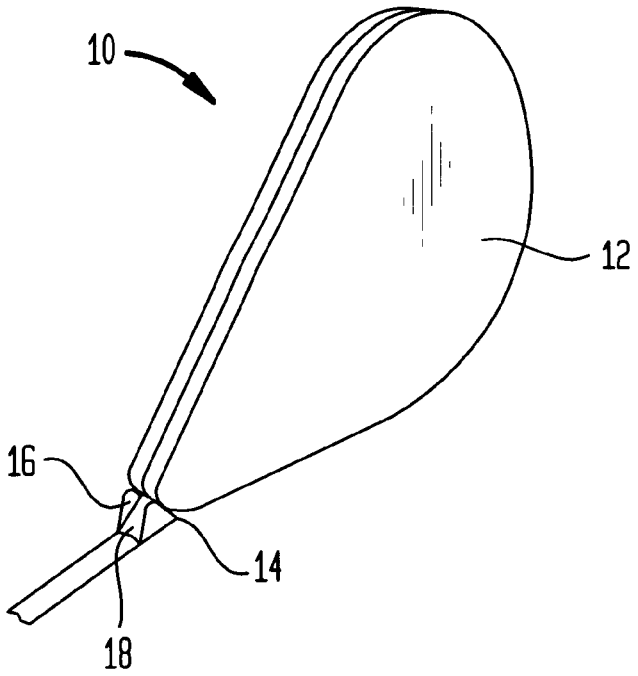
FIG. 1 illustrates the perspective drawing of an example of a prior art correction tape.
Figure 2:
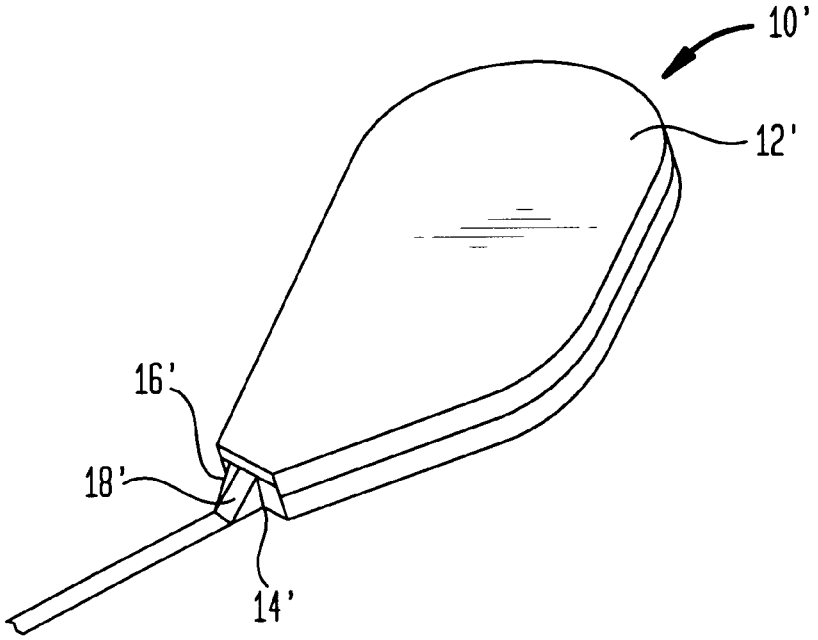
FIG. 2 illustrates the perspective drawing of an example of a modified correction tape which is also in the prior art.

FIGS. 1 and 2—Description of Prior Art Correction Tapes

In general, a correction tape is comprised of a case with a certain shape with opening hole, at least a pair of rolls which are installed in the case and rotate in their place and a tape guide which leads a thin tape wound around the rolls and movement of a thin tape and also pushes a thin tape towards a paper surface when necessary. Referring to FIGS. 1 and 2, regarding correction tapes, we illustrate the prior art correction tape.

FIG. 1 illustrates a prior art example of former correction tapes and FIG. 2 shows an example of a modified correction tape in the prior art.

A prior art correction tape 10 is shown in FIGS. 1 and 2. The correction tape 10 is comprised of a case 12, an opening hole 14, a tape guide 16 and a thin tape 18. A pair of rolls, not shown are installed in the case 12. The opening hole 14 is an opening in the case 12. The tape guide 16 projects out of the opening hole 14. The tape guide 16 leads the movement of the thin tape 18 on which correction liquid has been coated and when necessary, the tape guide 16 pushes the thin tape 18 towards a corresponding piece of paper. In the prior art correction tape 10 shown in FIG. 1, the tape guide 16 pushing the thin tape 18 has been placed in the thickness direction of the case 12. Contrary to this, in a correction tape 10' shown in FIG. 2, a tape guide 16' pushing the thin tape 18' has been placed in a vertical direction compared to the tape guide 16 in FIG. 1. The correction tapes 10 and 10' in drawings 1 and 2 are very similar in their structure or functions except that the direction of the tape guides 16 and 16' differ. But the correction tape 10' in FIG. 2 has an advantage of excellent stability during use, compared with the correction tape 10 in FIG. 1.

The former correction tapes 10 and 10' which are illustrated in FIGS. 1 and 2 have possibility that dust or foreign materials with stick to them and can penetrate into the cases 12 or 12' through the opening holes 14 or 14' because parts of the thin tape 18 or 18' have been exposed to the exterior when not in use. Besides, during carrying in a pocket, dust or foreign materials in a pocket might be stuck on the thin tape 18 or 18' or penetrate into the case 12 or 12'.

Namely, in case of using the former correction tapes 10 or 10', it might contaminate the correction film and shorten the life of the correction tape due to the penetration of foreign materials.

Description of Embodiments of Present Invention

Description of numbers for major parts in drawings.

| | |
|---|---|
| 100: | Correction tape |
| 110: | Case |
| 111: | Opening hole |
| 112: | Guide pin |
| 113: | Guide support |
| 114: | Check hole |
| 115: | Cap Holder |
| 116, 117: | Hole |
| 120: | First roll |
| 122: | Sawtooth |
| 130: | Second roll |
| 140, 142: | Thin tape |
| 150: | Tape guide |
| 160: | Cap |
| 162: | Slot |
| 164: | Bumps |
| 170, 175: | Clip |
| 172, 177: | Bumps for connection |

Figure 3:
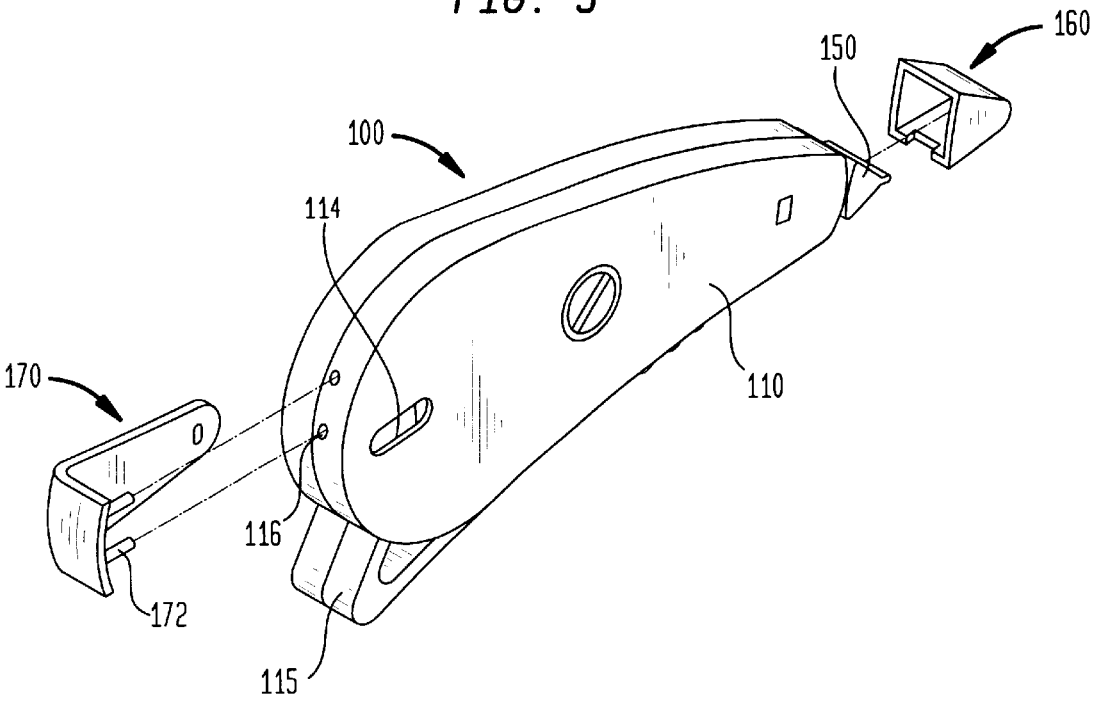
FIG. 3 illustrates a separated drawing of the correction tape in accordance with a first embodiment of the present invention.
Figure 4:
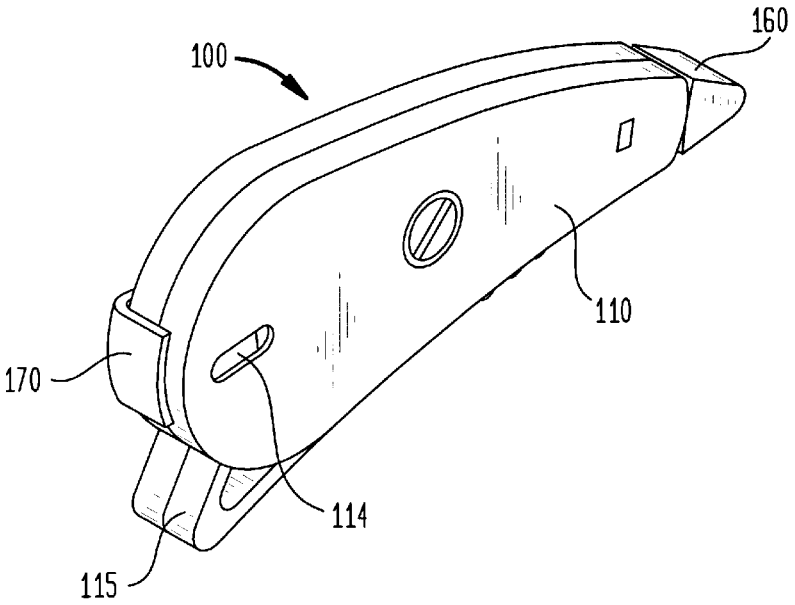
FIG. 4 illustrates a perspective drawing of the correction tape of a first embodiment of the present invention.
Figure 5:
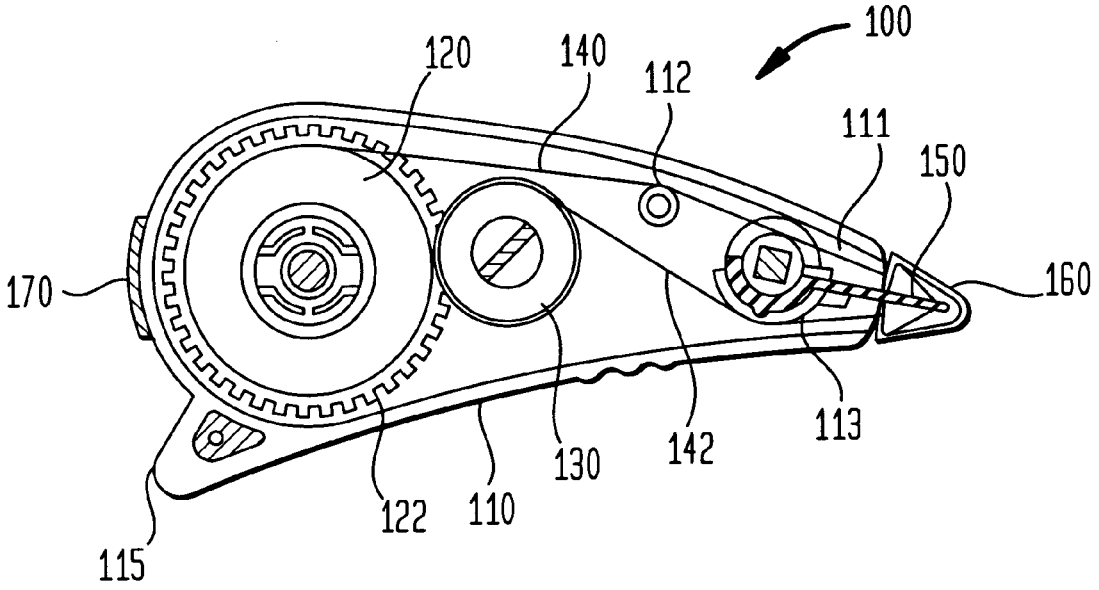
FIG. 5 illustrates an installation state of inner parts of the correction tape in FIG. 3.

FIG. 3 illustrates a separated perspective drawing of a correction tape 100 of an embodiment of the present invention and FIG. 4 is an assembled perspective drawing of the correction tape 100. FIG. 5 shows the installation state of the internal parts of the correction tape 100 in FIG. 3.

From FIGS. 3 to 5, the correction tape 100 of an embodiment of the present invention is illustrated. As illustrated, the correction tape 100 is comprised of a case 110. This case 110 shall be combined with two parts which are almost symmetrical and have enough room to install the parts in it. The case 110 has an opening hole 111 at one side as shown in FIG. 5.

In addition to case 110, the correction tape 100 is comprised of opening hole 111, guide pin 112, guide support 113, check hole 114, cap holder 115, holes 116 and 117, first roll 120, sawtooth 122, second roll 130, non-used thin tape 140 and used thin tape 142, tape guide 150, cap 160, slot 162, bumps 164, clips 170, and 175, and bumps for connection 172, and 177.

As illustrated in FIG. 5, the first roll 120 is placed on the inside of the case 110. This first roll 120 is rotatable in its place and thin tape 140 is wound around the first roll 120. At the bottom of this first roll 120 and around the circumference of the first roll 120 a sawtooth 122 is formed. As shown in FIG. 5, the first roll 120 has circular area which does not have sawtooth 122 upon which is wound the thin tape 140, and another circular area where sawtooth 122 is formed. The second roll 130 is located just near the first roll 120. This second roll 130 is also rotatable in its place and a sawtooth, not shown, just fittable to the sawtooth 122 of the first roll 120 shall be formed.

Here, while the first roll 120 and second roll 130 have a regular rotation ratio because those are fitted to each other, the diameter of the wound thin tape 140 around each roll shall be changed. Consequently, in order to avoid problems by the difference in diameter, considering the thickness of the thin tape 140 which is wound around the first roll 120 and wound around the second roll 130 after the thin film has been peeled off, the diameter of the first roll 120 and second roll 130 shall be appropriately controlled.

The second roll 130 is the place where the used thin tape 142 shall be wound. On the inside of the case 110, a guide pin 112 which leads the movement of the non-used thin tape 140 is located, and near this, the tape guide 150 is placed with the guide support 113 and part of the tape guide 150 is projected to the outside through the opening hole 111.

The thin tape 140 has been wound around the second roll (130), passing through the guide pin 112 and tape guide 150, in wound state around the first roll 120.

Once the thin tape 140 shall be pressed through the tape guide 150, a correction liquid which has been coated on the thin tape shall be coming off and applied to the surface of the paper. Namely, the tape 142 from which coated film has been coming off shall be wound around the second roll 130.

As illustrated in FIG. 4, there is a check hole 114 at the one side of the case 110 through which the amount of the thin tape 140 used shall be checked. In case the case 110 shall be made of transparent materials, a check hole 114 shall not be necessary.

As illustrated in FIGS. 3 and 5, the correction tape 100 of this embodiment has a cap 160. As covering onto the tape guide 150 when necessary, this cap 160 protects thin tape 140 against dust or foreign materials and penetration of dust or foreign materials into the inside of the case. Detailed description for the cap 160 shall be made later.

As illustrated in FIG. 4, a cap holder 115 is projected at the back of the case 110. The purpose of a cap holder 115 is to store the cap 160 when the correction tape 140 is being used. The cap 160 covers the tape guide 150 when the correction tape 140 is not in use.

The correction tape 100 has a clip 170. This clip 170 is for facilitating the carrying of the correction tape 100. As illustrated, the case 110 has holes 116 and the shaped clip 170 has two pins 172 to fit into the holes 116. Consequently the clip 170 can easily be taken on and off to the case 110 through the holes 116.

Therefore, the correction tape 100 can prevent dust or foreign materials from staining the thin tape 140 or 142 because it has a cap 160 protecting the tape guide 150 and a cap holder 115 to store cap 160 during use. Also it is very handy to carry because the clip 170 is installed at the outside of the case 110.

Figure 6:
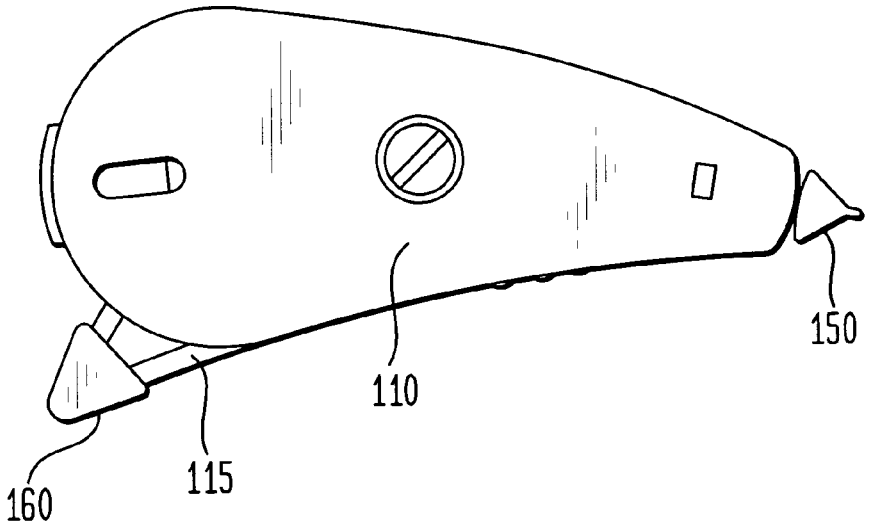
FIG. 6 illustrates the front view of the correction tape in FIG. 3, indicating that a cap is placed on a cap holder.

FIG. 6 illustrates the front view of the correction tape 100 in FIG. 3, showing that the cap 160 is stored on cap holder 115.

As illustrated in FIG. 6, the cap 160 is connected to the cap holder 115 which is located at the back of case 110. Under this state, holding the case 110 with hand, push the end of tape guide 150 to the paper to be corrected and move it. Then the correction liquid which has been coated on the thin tape 140 or 142 shall be applied to the paper. In case the correction tape 100 shall not be used, the cap 160 can be removed from the cap holder 115 and can be put into the end of tape guide 150.

Figure 7:
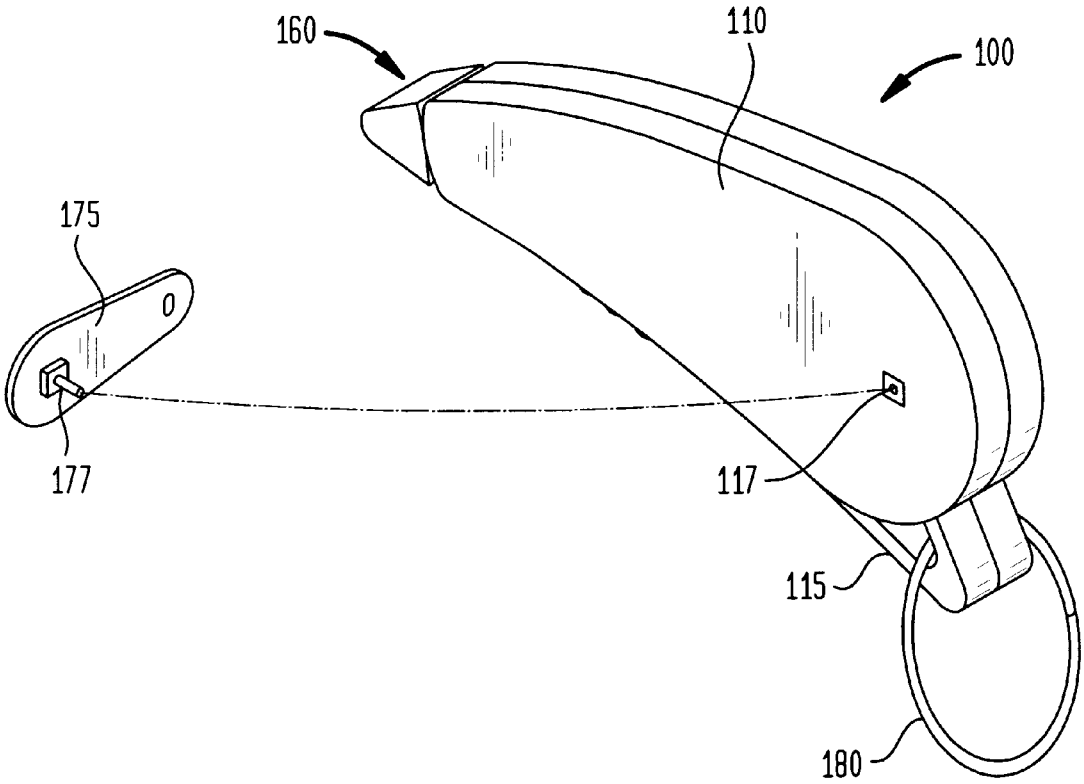
FIG. 7 illustrates a separated drawing of other examples of the correction tape in accordance with another embodiment of the present invention.

The case 110 of correction tape 100 by this design is illustrated in FIG. 7.

There is a hole 117 at one side of the case 110. This hole 117 is for attaching and detaching the clip 175. The clip 175 as illustrated in FIG. 7 has usually "1" shape and is comprised of projection pin 177. The clip 175 facilitates the carrying of the correction tape 100 in such a way that it shall be put into the pocket with the clip 175.

In some cases, a ring 180 can be added to the cap holder 115 as illustrated in FIG. 7. With the ring 180, the correction tape 100 can be hung on a nail or another place and carried on a waist belt.

Figure 8:
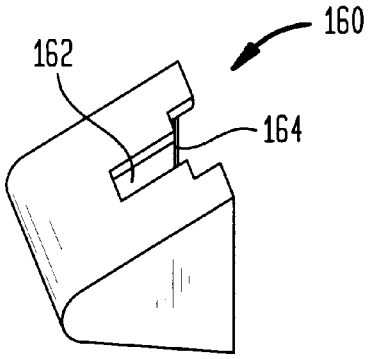
FIG. 8 illustrates a perspective drawing of the cap.

FIG. 8 is a perspective drawing of the cap 160.

The cap 160 is illustrated in FIG. 8. As illustrated, the shape of the cap 160 shall be such that it can facilitate the end of the tape guide 150 and it has a slot 162 with a certain length in one side. It is desirable that the slot 162 shall be located at the face to face position near the edge of the top and bottom of the cap 160. This slot 162 facilitates the attaching and detaching of the cap 160 by opening the front part of the cap 160 by hand. There are bumps 164 in the inside of both sides in the cap 160. These bumps 164, connected to the gap between tape guides 150 and case (110), help cap (160) not to be removed too easily when not held by hand.

As noticed from the above description, the correction tape 100 in accordance with an embodiment of the present invention has a cap 160 and cap holder 115, the cap 160 prevents dust or foreign materials from penetrating to the inside of the correction tape 100 or sticking to the thin tape 140, and the correction tape generally handy to use. Furthermore, the correction tape 100 is handy to carry and store because the clip 175 and ring 180 is installed at the case 110.

The following material was generally kept in from the foreign case claims in order to retain disclosure of the foreign claims:

As for correction tape which is comprised of a case with certain shape, a thin tape wound and rotationable first roll in the above case, a rotationable second roll, placed near the above first roll, which released thin tape from the above first roll, shall be wound around after passing through certain path and a tape guide, placed at the outside of the above case, which leads the movement of the above thin tape and pushes the above thin tape to the paper when necessary, the correction tape which is characterized by attachable and removable cap, which protects the above exposed tape guide and the above thin tape and a cap holder, placed at the outside of the above case, which stores the above cap when necessary.

The correction tape which is characterized by the clip installed at the above case.

The correction tape which is characterized by the slot with certain length, formed at the near of the above cap opening hole, and bumps, formed inwards, which fits between the above case and tape guide.

As for the above three paragraphs, the correction tape which is characterized by the check hole, formed at the one side of the above case, through which the amount of use of the above thin tape can be checked and the ring which is connected to the above cap holder.

I claim:

1. An apparatus comprising:

a tape guide;

a case, the tape guide fixed to the case;

a thin tape comprised of correction fluid for correcting written mistakes;

the thin tape being lead around the tape guide, the thin tape comprised of correction fluid;

a cap adaptable for covering the tape guide;

wherein the cap is adaptable to be attached to the case at a first location and when attached to the case at the first location covers the tape guide;

and wherein the cap is adaptable to be detached from the first location of the case and when detached from the first location of the case, the cap no longer covers the tape guide.

2. The apparatus of claim 1 further comprised of:

a first roll rotatably mounted to the case;

a second roll rotatably mounted to the case; and wherein the thin tape is wound around the first roll, proceeds from the first roll to the tape guide, is lead around the tape guide, and then proceeds to the second roll where the thin tape is wound around the second roll.

3. The apparatus of claim 2 wherein:

the first roll has a first gear portion;

the second roll has a second gear portion;

the first gear portion of the first roll and the second gear portion of the second roll engage one another so that when the first roll rotates, the second roll also rotates.

4. The apparatus of claim 1 and further wherein:

the case is comprised of a cap holder at a second location of the case;

and wherein the cap holder is adaptable for holding the cap at the second location of the case when the cap is not attached at the first location on the case and when the cap is not covering the tape guide.

5. The apparatus of claim 1 and further wherein:

the case is comprised of a clip for for putting the device into someone's pocket;

and wherein the clip can be attached and detached from a second location on the case so that the clip is removable from the case.

6. The apparatus of claim 2 and further wherein:

the cap is comprised of two internal sides, each internal side having a bump, wherein when the cap covers the tape guide the bumps will lie in a gap between the tape guide and the case, and thereby it will help the cap not to fall off.

7. An apparatus comprising:

a tape guide;

a case, the tape guide fixed to the case;

a thin tape comprised of correction fluid for correcting written mistakes;

the thin tape being lead around the tape guide, so that a portion of the thin tape surrounds the tape guide, the thin tape comprised of correction fluid;

a cap adaptable for covering the tape guide by being attached at a first location of the case;

wherein while the cap is attached at the first location of the case, the portion of the thin tape that surrounds the tape guide lies inside of the cap.

8. The apparatus of claim 7 further comprised of:

a first roll rotatably mounted to the case;

a second roll rotatably mounted to the case; and wherein the thin tape is wound around the first roll, proceeds from the first roll to the tape guide, is lead around the tape guide, and then proceeds to the second roll where the thin tape is wound around the second roll.

9. The apparatus of claim 8 wherein:

the first roll has a first gear portion;

the second roll has a second gear portion;

the first gear portion of the first roll and the second gear portion of the second roll engage one another so that when the first roll rotates, the second roll also rotates.

10. The apparatus of claim 7 further wherein:

the case is comprised of a cap holder at a second location of the case;

and wherein the cap holder is adaptable for holding the cap at the second location of the case when the cap is not attached at the first location on the case and when the cap is not covering the tape guide.

11. The apparatus of claim 7 further wherein:

the case is comprised of a clip for putting the device into someone's pocket;

and wherein the clip is adaptable to be attached and detached from a second location on the case so that the clip can be removed from the case.

12. The apparatus of claim 8 and further wherein:

the cap is comprised of two internal sides, each internal side having a bump, wherein when the cap covers the tape guide the bumps will lie in a gap between the tape guide and the case, and thereby it will help the cap not to fall off.

13. The apparatus of claim 7 and wherein the cap has a plurality of sides and the cap has a slot in one of the plurality of sides.

14. The apparatus of claim 10 further comprised of a ring which is adaptable to attach to the cap holder when the cap is not being held to the cap holder.

15. The apparatus of claim 8 wherein there is a check hole located in a side of the case, and wherein through the check hole one can view the amount of tape remaining on the first roll.

16. The apparatus of claim 7 further wherein the cap is adapted to be detached from the first location of the case and when detached from the first location of the case, the cap no longer covers the tape guide.

17. The apparatus of claim 16 further comprised of:

a first roll rotatably mounted to the case;

a second roll rotatably mounted to the case; and wherein the thin tape is wound around the first roll, proceeds from the first roll to the tape guide, is lead around the tape guide, and then proceeds to the second roll where the thin tape is wound around the second roll.

18. The apparatus of claim 17 and further wherein:

the cap is comprised of two internal sides, each internal side having a bump, wherein when the cap covers the tape guide the bumps will lie in a gap between the tape guide and the case, and thereby it will help the cap not to fall off.

19. An apparatus comprising:

a tape guide;

a case, the tape guide fixed to the case;

a thin tape comprised of correction fluid for correcting written mistakes;

the thin tape being lead around the tape guide, the thin tape comprised of correction fluid; and a cap adaptable for covering the tape guide, and wherein the case is comprised of a clip for for putting the device into someone's pocket;

and wherein the clip is adaptable to be attached and detached from a second location on the case so that the clip can be removed from the case.

* * * * *